US008543051B2

(12) United States Patent
Akatsuka et al.

(10) Patent No.: US 8,543,051 B2
(45) Date of Patent: Sep. 24, 2013

(54) IMAGE FORMING APPARATUS AND SHEET FEEDING DEVICE

(75) Inventors: Yasunori Akatsuka, Kitanagoya (JP); Akira Terao, Ama (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 375 days.

(21) Appl. No.: 12/886,912

(22) Filed: Sep. 21, 2010

(65) Prior Publication Data

US 2011/0150553 A1 Jun. 23, 2011

(30) Foreign Application Priority Data

Dec. 23, 2009 (JP) ..... 2009-291576

(51) Int. Cl.
*G03G 15/00* (2006.01)

(52) U.S. Cl.
USPC ..... 399/388; 399/98; 399/392; 271/225

(58) Field of Classification Search
USPC ..... 399/392, 388, 390, 34, 98, 99; 271/225
See application file for complete search history.

(56) References Cited

U.S. PATENT DOCUMENTS

| | | | | |
|---|---|---|---|---|
| 5,351,108 | A | 9/1994 | Mizutani | |
| 6,219,505 | B1 | 4/2001 | Sato et al. | |
| 2001/0028813 | A1 | 10/2001 | Nishimura et al. | |
| 2001/0031154 | A1 | 10/2001 | Sato et al. | |
| 2002/0131801 | A1 * | 9/2002 | Tomatsu | 399/400 |
| 2003/0049043 | A1 | 3/2003 | Fuwazaki et al. | |
| 2007/0209539 | A1 * | 9/2007 | Mori | 101/425 |
| 2007/0231032 | A1 * | 10/2007 | Matsuno | 399/388 |
| 2009/0324279 | A1 * | 12/2009 | Miyahara et al. | 399/101 |
| 2010/0303523 | A1 * | 12/2010 | Yamada | 399/323 |

FOREIGN PATENT DOCUMENTS

| | | |
|---|---|---|
| JP | H5-193773 | 8/1993 |
| JP | 10-39720 | 2/1998 |

(Continued)

OTHER PUBLICATIONS

Machine Translation of JP,2004-323144 Goto, Hiroyuki published Nov. 18, 2004.*

(Continued)

*Primary Examiner* — Ren Yan
*Assistant Examiner* — Allister Primo
(74) *Attorney, Agent, or Firm* — Scully, Scott, Murphy & Presser, P.C.

(57) ABSTRACT

An image forming apparatus includes: an image forming part; a paper dust collecting roller that collects paper dust from a sheet; a conveying roller that is opposed to the paper dust collecting roller and conveys the sheet; a paper dust removing member that contacts the paper dust collecting roller for removing the paper dust therefrom; a supporting member that extends in a width direction of the sheet; a swing shaft for swinging the supporting member; and a pressing member that presses the supporting member for contacting the paper dust removing member with the paper dust collecting roller. The supporting member includes: a guiding surface that contacts the sheet conveyed along the conveying path for guiding the sheet toward the image forming part along the conveying path; and a paper dust receiving part which receives the paper dust removed by the paper dust removing member.

14 Claims, 4 Drawing Sheets

(56) References Cited

FOREIGN PATENT DOCUMENTS

| | | |
|---|---|---|
| JP | 10-186981 | 7/1998 |
| JP | 2000-219360 | 8/2000 |
| JP | 2001-270631 | 10/2001 |
| JP | 2002-108153 | 4/2002 |
| JP | 2003-226441 | 8/2003 |
| JP | A-2004-323144 | 11/2004 |

OTHER PUBLICATIONS

Decision of Refusal dated Apr. 24, 2012 received from the Japanese Patent Office from related Japanese Application No. 2009-291576, together with an English-language translation.

Notification of Reasons for Refusal dated Dec. 6, 2011 received from the Japanese Patent Office from related Japanese Application No. 2009-291576, together with an English-language translation.

* cited by examiner

IMAGE FORMING APPARATUS AND SHEET FEEDING DEVICE

CROSS-REFERENCE TO RELATED APPLICATIONS

This application claims priority from Japanese Patent Application No. 2009-291576 filed on Dec. 23, 2009, the entire subject matter of which is incorporated herein by reference.

TECHNICAL FIELD

The present invention relates to an image forming apparatus and a sheet feeding device including a paper dust collecting roller that collects paper dust from a sheet by contacting the sheet and a paper dust removing member that removes the paper dust collected onto the paper dust collecting roller.

BACKGROUND

In general, with respect to a sheet used for an image forming apparatus, paper dust may be generated on a surface of the sheet due to a frictional contact a feeder pat in a process of feeding and/or conveying the sheet. In addition, the paper dust may also be generated and attached on the surface of the sheet when manufacturing the sheet (for example, in the process of cutting the sheet to a definite size), and such a sheet may be set to the image forming apparatus. The paper dust attached onto the surface of the sheet may cause improper control of the image forming apparatus and may deteriorate printing quality on the sheet. Thus, it is preferable to remove the paper dust.

There has been proposed various image forming apparatuses and sheet feeding devices including a paper dust collecting roller and a paper dust removing member. For example, a known image forming apparatus includes a paper dust capturing unit that includes a paper dust collecting roller and a paper dust removing member. The paper dust capturing unit includes a paper dust collecting roller, a driving roller, a sponge member (a paper dust removing member) and an auger member. The paper dust of the sheet conveyed with the driving roller is collected by contacting the paper dust collecting roller with the sheet. Then, by contacting the sponge member with the paper dust collecting roller, the paper dust is removed from the paper collecting roller. The paper dust removed with the sponge member drops to a receiving surface of a guide member due to gravity and is conveyed with the auger member to be stored in a paper dust storage part.

SUMMARY

As described above, in the known image forming apparatus, the paper dust capturing unit includes the paper dust collecting roller, the paper dust removing member, the auger member, the guide member and the supporting member, and the paper dust removing member is provided above the paper dust collecting roller and under the supporting member, which is pressed downwards by the pressing force of a spring. In addition, the guide member having a receiving surface and the auger member are provided adjacent to the paper dust removing member.

Thus, since the paper dust capturing unit according to the known image forming apparatus is composed of many members, the paper dust capturing unit occupies a large space in the image forming apparatus. Recently, it has been demanded to reduce a size of image forming apparatuses. However, it is difficult for the known image forming apparatus to meet such a demand.

The present invention relates to an image forming apparatus and a sheet feeding device, which include a paper dust collecting roller and a paper dust removing member, and which is capable of removing a paper dust in a small setting space to convey the sheet smoothly.

According to one illustrative aspect of the invention, there is provided an image forming apparatus comprising: an image forming part that forms an image on a sheet; a paper dust collecting roller that collects paper dust from the sheet conveyed along a conveying path toward the image forming part; a conveying roller, which is provided in a position opposed to the paper dust collecting roller, and which conveys the sheet toward the image forming part; a paper dust removing member, which is provided upstream in a conveying direction of the sheet from the paper dust collecting roller and the conveying roller in the conveying path, and which contacts the paper dust collecting roller for removing the paper dust collected onto the paper dust collecting roller; a supporting member, which comprises the paper dust removing member, and which extends in a width direction of the sheet conveyed along the conveying path; a swing shaft, which is provided in parallel with a rotation axis of the paper dust collecting roller, and which supports the supporting member for allowing the supporting member to swing around the swing shaft; and a pressing member that applies a pressing force to the supporting member so as to rotate the supporting member around the swing shaft in a direction in which the paper dust removing member contacts the paper dust collecting roller, wherein the supporting member comprises: a guiding surface that contacts the sheet conveyed along the conveying path for guiding the sheet toward the image forming part along the conveying path; and a paper dust receiving part, which is provided at a back side of the guiding surface and upstream in the conveying direction of the sheet from the paper dust removing member, and which receives the paper dust removed by the paper dust removing member.

According thereto, the image forming apparatus can reliably remove the paper dust attached onto the sheet and form images. In addition, when the sheet is conveyed along the conveying path, the sheet contacts the guiding surface of the supporting member and is guided along the conveying path with the guiding surface. Therefore, the image forming apparatus allows the supporting member, with which the paper dust removing member is provided, to function as a paper dust removing mechanism and a mechanism for conveying smoothly the sheet. Furthermore, since the supporting member is supported by a shaft and able to swing around the shaft, when the sheet contacts the guiding surface, it moves toward the direction in which the paper dust removing member is pressed against the paper dust collecting roller. Then, with the pressing force of the pressing member, the supporting member returns to a predetermined position where the paper dust removing member contacts the paper dust collecting roller. Because of the contact of this sheet and the guiding surface, and the movement resulting from the pressing force of the pressing member, the paper dust removed with the paper dust removing member drops from the paper dust removing member to a paper dust receiving part. In this way, the image forming apparatus can appropriately handle the paper dust removed from the sheet. Furthermore, the supporting member can function not only as a mechanism for removing paper dust, but also as a member for smoothly conveying the sheet. Therefore, with respect to the image forming apparatus, compared with the paper dust removing mechanism and the member for smoothly conveying the sheet that are separately provided, the paper dust removing mechanism including the supporting member can be arranged in a small space. As a result, for the image forming apparatus, the arrangement area of the paper dust removing mechanism is reduced in this way, which contributes to reduce the size of the image forming apparatus itself, in order to meet the user's demand for reducing the size of the apparatus.

According to another illustrative aspect of the invention, there is provided a sheet feeding device comprising: a paper dust collecting roller that collects paper dust from a sheet conveyed along a conveying path; a conveying roller, which is provided in a position opposed to the paper dust collecting roller, and which conveys the sheet along the conveying path; a paper dust removing member, which is provided upstream in a conveying direction of the sheet from the paper dust collecting roller and the conveying roller in the conveying path, and which contacts the paper dust collecting roller for removing the paper dust collected onto the paper dust collecting roller; a supporting member, which comprises the paper dust removing member, and which extends in a width direction of the sheet conveyed along the conveying path; a swing shaft, which is provided in parallel with a rotation axis of the paper dust collecting roller, and which supports the supporting member for allowing the supporting member to swing around the swing shaft; a pressing member that applies a pressing force to the supporting member so as to rotate the supporting member around the swing shaft in the direction in which the paper dust removing member contacts the paper dust collecting roller, wherein the supporting member comprises: a guiding surface that contacts the sheet conveyed along the conveying path for guiding the sheet along the conveying path; and a to paper dust receiving part, which is provided at a back side of the guiding surface and upstream in the conveying direction of the sheet from the paper dust removing member, and which receives the paper dust removed by the paper dust removing member.

According thereto, the sheet feeding device allows the supporting member, with which the paper dust removing member is provided, to function as a paper dust removing mechanism and a mechanism for conveying smoothly the sheet. In addition, since the supporting member is supported by a shaft and able to swing around the shaft, the image forming apparatus can appropriately handle the paper dust removed from the sheet. Furthermore, because the sheet feeding device can function not only as a mechanism for removing paper dust of the sheet but also as a member for smoothly conveying the sheet, the arrangement area of the sheet feeding device can be reduced, and such sheet feeding device can contribute to reduce the size of the image forming apparatus to which the sheet feeding device is installed.

DETAILED DESCRIPTION

Hereinafter, exemplary embodiments of the present invention, in which an image forming apparatus and a sheet feeding device are embodied as a laser printer 1, will be described in detail with reference to the drawings. Incidentally, in the following description, directions are based on a user who is using the laser printer 1. That is, with respect to a plane of FIG. 1, the right side is referred to as "front side", the left side is referred to as "back side", the front side is referred to as "left side", and the back side is referred to as "right side". In addition, the upwards/downwards is referred to as "upwards/downwards".

Figure 1:
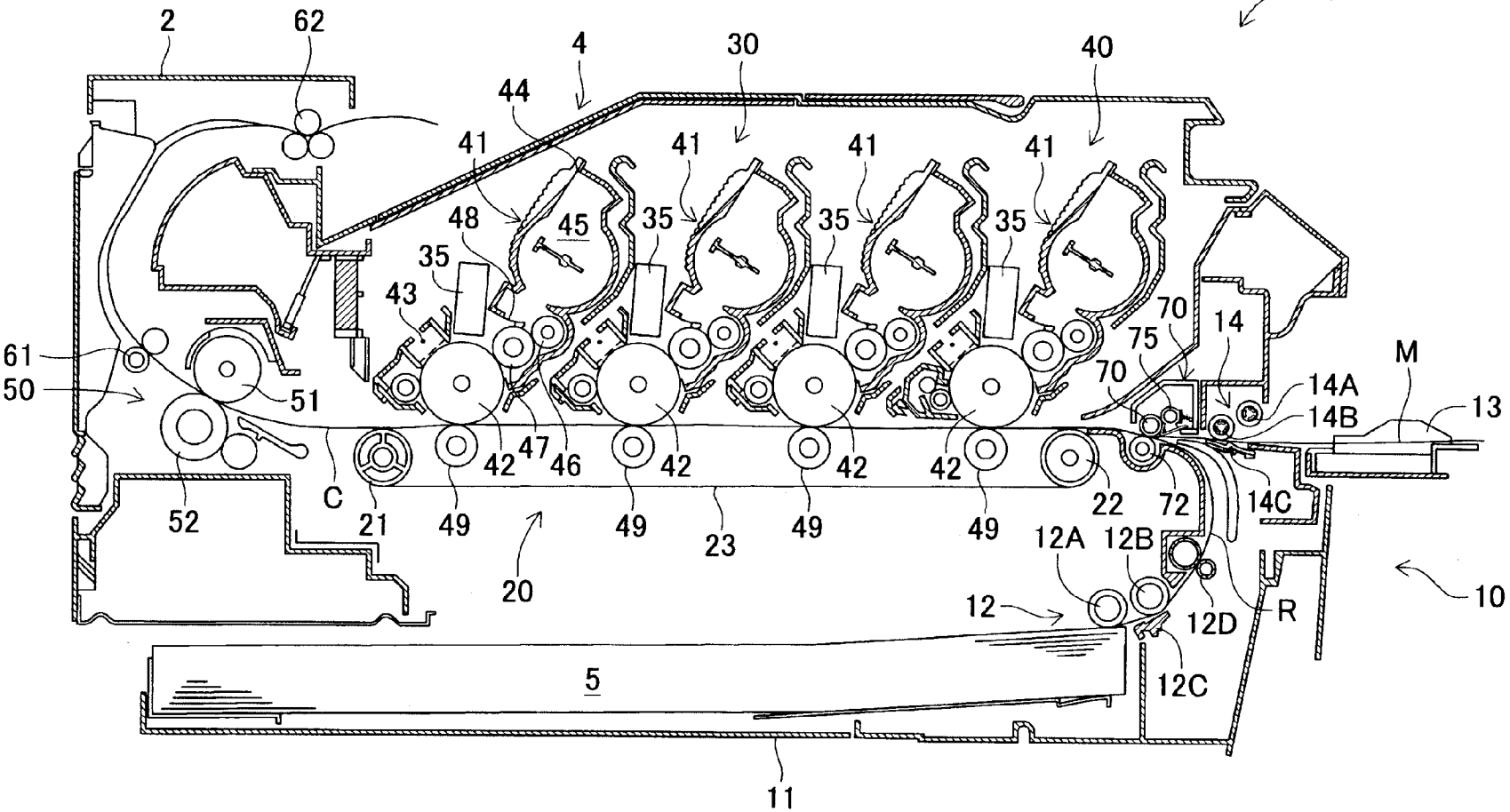
FIG. 1 is a cross section diagram of a laser printer according to the exemplary embodiment of the invention.

The laser printer 1 according to the exemplary embodiment is a direct transfer tandem type color laser printer. As shown in FIG. 1, the laser printer 1 includes a housing 2 that has a substantially box shape. The housing 2 includes a sheet discharging tray 4 and a manual feed tray 13. The sheet discharging tray 4 is formed on the housing 2 and stores a sheet 5 on which an image is formed by the laser printer 1. The manual feed tray 13 is used when the sheet 5 is fed from the front side of the laser printer 1 (Refer to FIG. 1). The manual feed tray 13 is provided in front of the housing 2 and may move freely backwards and forwards with using a lower part thereof as a supporting point.

The housing 2 accommodates a feeder unit 10, a sheet conveying part 20, an image forming unit 30 and a paper dust removing unit 70. The feeder unit 10 feeds the sheet 5, which is used as a recording medium. The sheet conveying part 20 conveys the sheet 5 fed by the feeder unit 10. The image forming unit 30 forms an image on the sheet 5 fed by the sheet conveying part 20, etc. The paper dust removing unit 70 removes paper dust P attached onto the sheet 5. The housing 2 internally accommodates a control part (not shown) for controlling the feeder unit 10, the sheet conveying part 20 and the image forming unit 30. Incidentally, a structure of the paper dust removing unit 70 will be described later.

The feeder unit 10 of the laser printer 1 will be described. The feeder unit 10 includes a sheet feed tray 11 (one example of a first sheet feed tray), a first sheet feeding unit 12, a manual feed tray 13 (one example of a second sheet feed tray) and a second sheet feeding unit 14. The sheets 5 are accommodated in stack in the sheet feed tray 11. The sheet feed tray 11 is provided at a lower part of the housing 2. That is, the sheet feed tray 11 is provided below the image forming unit 30. The sheet feed tray 11 is removably mounted to the housing 2 and can be drawn out toward the front side. The first sheet feeding unit 12 is provided above the front end of the sheet feed tray 11 to feed the sheets 5 accommodated in the sheet feed tray 11. The second sheet feeding unit 14 feeds the sheet 5 carried on the manual feed tray 13.

The first sheet feeding unit 12 includes a sheet feeding roller 12A, a separation roller 12B, a separation pad 12C and a conveying roller 12D. The sheet feeding roller 12A feeds the sheets 5 in the sheet feed tray 11 from the sheet feed tray 11 to the separation roller 12B. The separation roller 12B cooperates with the separation pad 12C to separate the fed sheets 5 one at a time. The conveying roller 12D conveys the sheet 5 separated by the separation roller 12B and the separation pad 12C to the sheet conveying part 20.

The second feeder unit 14 includes a manual feeding roller 14A, a manual separation roller 14B and a manual separation pad 14C. The manual feeding roller 14A feeds the sheets 5 on the manual feed tray 13 from the manual feed tray 13 to the inside of the housing 2. The manual separation roller 14B cooperates with the manual separation pad 14C to separate the fed sheets 5 piece by piece. In addition, the paper dust removing unit 70 is provided adjacent to the second sheet feeding unit 14 and downstream in the conveying direction of the sheets 5.

The sheet conveying part 20 of the laser printer 1 will be described. The sheet conveying part 20 conveys the sheet 5 conveyed from the feeder unit 10 to the inside of the image forming unit 30 so as to convey the sheet 5 toward the sheet discharging tray 4. The sheet conveying part 20 includes a driving roller 21, a driven roller 22 and a conveying belt 23.

The driving roller 21 drives rotatively with the operation of the image forming unit 30. The driven roller 22 is separated from the driving roller 21 by a predetermined size and is provided parallel to the driving roller 21. The conveying belt 23 is made of an endless belt and is installed between the driving roller 21 and the driven roller 22. Then, the conveying belt 23 makes cyclic movement in a predetermined direction with the rotative drive of the driving roller 21. Therefore, the sheet conveying part 20 can convey the sheet 5 on the conveying belt 23 to the back side of the housing 2.

The image forming unit 30 of the laser printer 1 will be described. The image forming unit 30 includes a LED unit 35, a processing part 40 and a fixing part 50. The LED unit 35 forms an electrostatic latent image on the surfaces of photosensitive drums 42 as a part of the processing part 40. The processing part 40 develops the electrostatic latent image formed by the LED unit 35 with developer and transfers the developed image to the surface of the sheet 5 conveyed by the sheet conveying part 20. Incidentally, toner is one example of the developer. The fixing part 50 thermally fixes the image transferred by the processing part 40 on the sheet 5.

Based on image data or a control command input from the control part (not shown), the LED unit 35 exposes the surfaces of the photosensitive drums 42 with LED (not shown). The laser printer 1 includes four LED units 35 corresponding to black (K), yellow (Y), magenta (M) and cyan (C) respectively from the front side of the laser printer 1. Each LED unit 35 irradiates the surface of the photosensitive drum 42 with light respectively corresponding to the image forming unit 41 at the timing and the irradiation rate based on the control command. Incidentally, detailed description of the LED unit 35 is omitted.

The processing part 40 includes four image forming units 41 and four transferring rollers 49. The four image forming units 41 correspond to black (K), yellow (Y), magenta (M), cyan (C) respectively from the front side of the laser printer 1. Each image forming unit 41 includes a photosensitive drum 42, a charger 43 and a developing cartridge 44. The photosensitive drums 42 are provided along the conveying direction of the conveying belt 23, and the surfaces of the photosensitive drums 42 contact the surface of the conveying belt 23.

The charger 43 is provided in a position obliquely above the back side of each photosensitive drum 42, separated from the surface of the photosensitive drum 42 by a predetermined distance, and opposed to the photosensitive drum 42. The charger 43 uniformly charges the surface of the photosensitive drum 42 by the occurrence of corona discharge.

The developing cartridge 44 includes a toner accommodating chamber 45, a supply roller 46, a developing roller 47 and a layer thickness regulating blade 48. The toner accommodating chamber 45 each accommodates the toner of any one of black, yellow, magenta and cyan used for forming color images. The supply roller 46 supplies the toner from the toner accommodating chamber 45 to the surface of the developing roller 47. The developing roller 47 supplies the toner supplied from the toner accommodating chamber 45 to the surface of the photosensitive drum 42. The layer thickness regulating blade 48 regulates the thickness of the toner layer supported by the developing roller 47 to a certain thickness.

The transferring rollers 49 are provided in positions opposed to respectively, the photosensitive drums 42 as parts of the image forming unit 41 through the conveying belt 23. A transfer bias is applied on the transferring roller 49 when the image is transferred to the sheet 5.

Then, the fixing part 50 heats and melts the toner transferred to the sheet 5 so as to fix the image on the sheet 5. The fixing part 50 includes a heating roller 51 and a pressure roller 52. The heating roller 51 is provided on or above the printing side of the sheet 5 downstream from the sheet conveying part 20 in the conveying direction of the sheet 5. The heating roller 51 conveys the sheet 5 at the same time of heating the toner transferred to the sheet 5. The pressure roller 52 is provided at a position opposed to the heating roller 51 downstream from the sheet conveying part 20 in the conveying direction of the sheet 5, and presses the sheet 5 against the heating roller 51.

Printing operation for forming an image on the sheet 5 in the laser printer 1 will be described. First, a case where the sheet 5 is fed from the sheet feed tray 11 will be described. With the start of the printing operation, the sheet feeding roller 12A in the first sheet feeding unit 12 rotates. With the rotation of the sheet feeding roller 12A, sheets 5 stacked on the sheet feed tray 11 are conveyed toward the separation roller 12B and the separation pad 12C. After the sheet 5 is conveyed to the separation roller 12B and the separation pad 12C, the sheet 5 is separated piece by piece and is conveyed toward the conveying roller 12D along a first conveying path R. Incidentally, the first conveying path R is path which draws an arc upward from the front end of the sheet feed tray 11 and extends toward the paper dust removing unit 70 and the sheet conveying part 20 (refer to FIG. 1). The first conveying path R is connected to a common conveying path C (which will be described later) at a downstream end in the conveying direction of the sheet 5.

Next, a case where the sheet 5 is fed from the manual feed tray 13 will be described. In the case, with the starting of the printing operation, the manual feeding roller 14A in the second sheet feeding unit 14 rotates. With the rotation of the manual feeding roller 14A, sheets 5 stacked on the manual feed tray 13 are conveyed toward the second manual separation roller 14B and the manual separation pad 14C along a second conveying path M that extends in the substantially horizontal direction. The second conveying path M is a path that extends in the substantially horizontal direction from the back end (namely, the downstream end in the conveying direction) of the manual feed tray 13 toward the paper dust removing unit 70 and the sheet conveying part 20 (refer to FIG. 1). When the sheet 5 is conveyed to the manual separation roller 14B and the manual separation pad 14C, it is separated piece by piece. The sheet 5 is conveyed along the second conveying path M, and, through the paper dust removing unit 70, conveyed toward the sheet conveying part 20. In addition, the second conveying path M is connected to the common conveying path C (which will be described later) at the downstream end in the conveying direction of the sheet 5.

Here, in the case of printing on the sheet 5, first, the surface of each photosensitive drum 42 is uniformly charged by the charger 43. Then, the surface of each photosensitive drum 42 is exposed to the LED light irradiated from each LED unit 35. In this way, an electrostatic latent image is formed on each photosensitive drum 42 based on image data.

Then, the toner in the toner accommodating chamber 45 is supplied to the developing roller 47 with the rotation of the supply roller 46. The toner enters into positions between the developing roller 47 and the layer thickness regulating blade 48 with the rotation of the developing roller 47, and is supported on the developing roller 47 as a thin layer with a certain thickness.

When the developing roller 47 contacts the surface of the photosensitive drum 42, the toner supported on the developing roller 47 is supplied to the photosensitive drum 42. In this way, the toner is selectively supported on the photosensitive drum 42, and the electrostatic latent image is visualized. That is to say, a toner image is formed on the photosensitive drum 42 with reverse development.

As described above, after passing an intersection point (junction) I (which will be described later), the sheet 5 fed with the first sheet feeding unit 12 or the second sheet feeding unit 14 is conveyed along the common conveying path C. Specifically, the sheet 5 is driven by the conveying belt 23 to pass the position between the photosensitive drum 42 and the transferring roller 49 as a part of the common conveying path C. At this time, the toner image formed on each photosensitive drum 42 is transferred to the sheet 5. After passing the sheet conveying part 20, the sheet 5 reaches the fixing part 50. At this time, the toner image transferred on the sheet 5 is thermally fixed on the sheet 5 as the sheet 5 passes the position between the heating roller 51 and the pressure roller 52 as a part of the common conveying path C.

Then, the sheet 5 on which the image was thermally fixed is further conveyed by the discharging roller 61 along the common conveying path C, and is discharged to the sheet discharging tray 4 by the sheet discharging roller 62. Here, the common conveying path C is a path, which starts from the intersection point (junction) I of the first conveying path R and the second conveying path M, extends on the conveying belt 23, passes between the heating roller 51 and the pressure roller 52, draw an arc upward, and reaches the sheet discharging tray 4.

In this way, the laser printer 1 according to the exemplary embodiment can print with the sheet 5 on the sheet feed tray 11 or the sheet 5 on the manual feed tray 13. In the laser printer 1, the first conveying path R used at the time of printing with the sheet feed tray 11 and the second conveying path M used at the time of printing with the manual feed tray 13 are connected with the common conveying path C at the intersection point I.

Next, the paper dust removing unit 70 in the laser printer 1 according to the exemplary embodiment will be described in detail with reference to the drawings. As shown in FIG. 1, the paper dust removing unit 70 removes the paper dust P attached onto the sheet 5. The paper dust removing unit 70 is provided adjacent to the second sheet feeding unit 14 downstream in the conveying direction of the sheet 5. The paper dust removing unit 70 includes a paper dust collecting roller 71, a sheet conveying roller 72, a paper dust removing member 73, a coil spring 74 and a supporting frame 75 (refer to FIGS. 2 to 5).

The paper dust collecting roller 71 has a fluorine resin layer on the surface of roller shaft. The paper dust collecting roller 71 is provided such that the image forming surface of the sheet 5 contacts the fluorine resin layer. Since the fluorine resin layer is easy to be charged, when contacting the sheet 5 charged through friction, the fluorine resin layer can collect and remove the paper dust attached onto the image forming surface of the sheet 5 with electric charge attraction (refer to FIGS. 4 and 5). Incidentally, another structure can be adopted as long as the surface of the paper dust collecting roller 71 is easy to be charged. For example, the surface may be applied with a fluorine coating.

Figure 2:
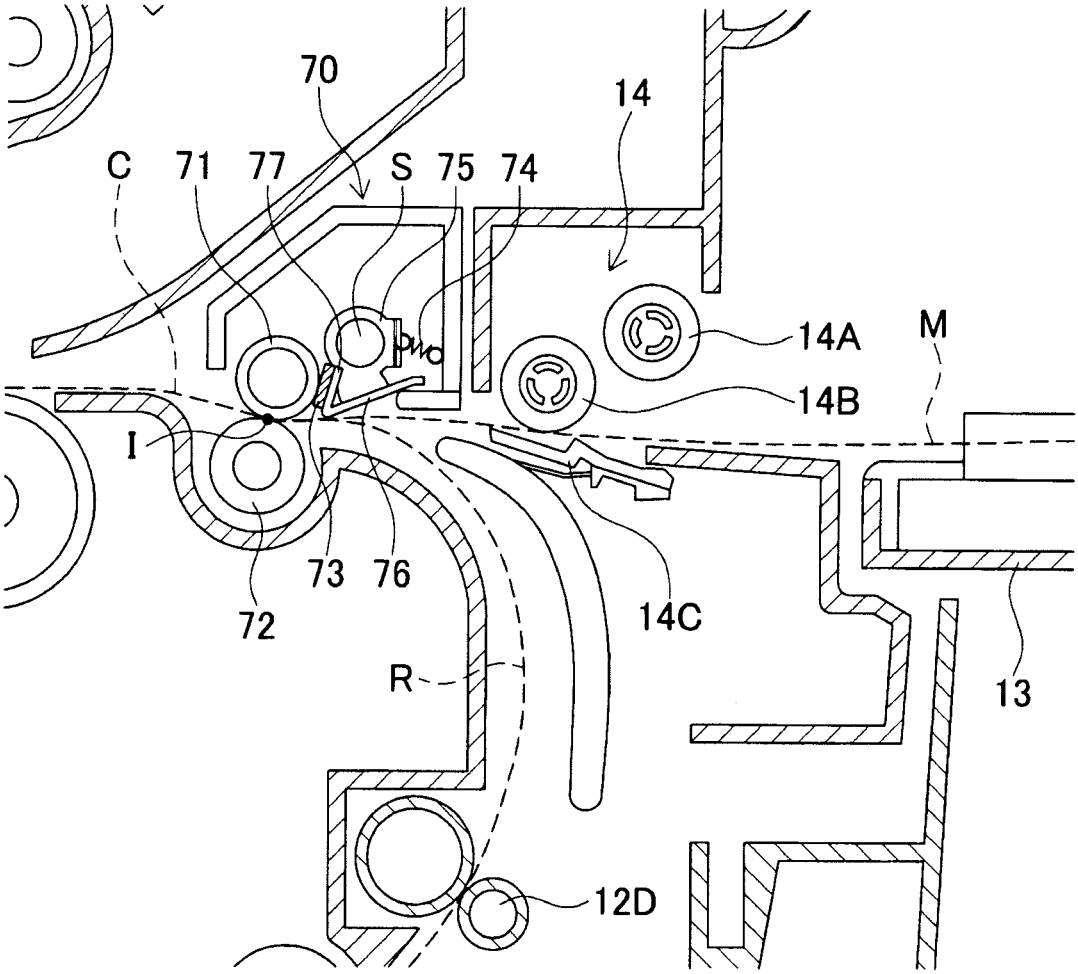
FIG. 2 is a schematic enlarged diagram of the image forming apparatus showing a paper dust removing unit.
Figure 4:
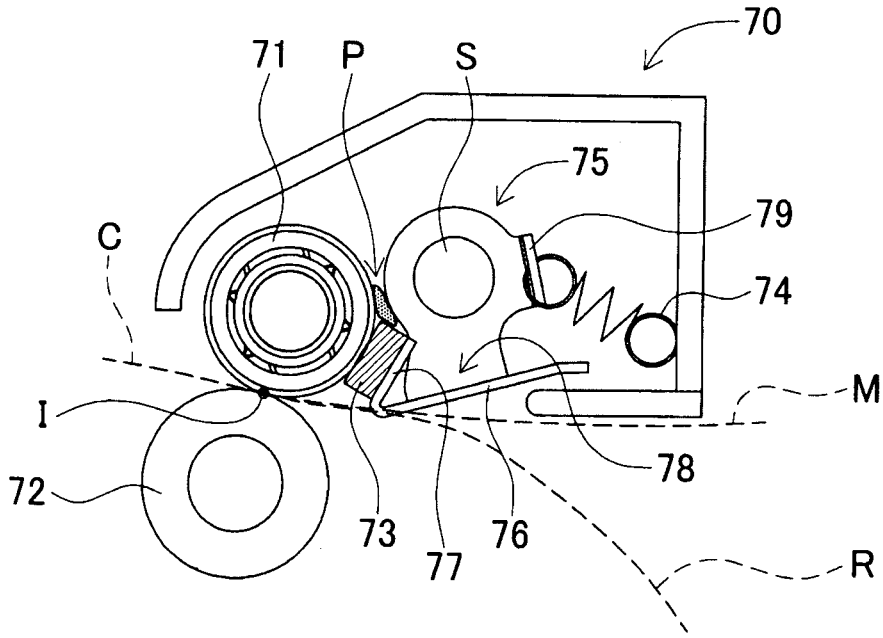
FIG. 4 is an illustrative diagram of the paper dust removing unit showing a state in which the paper dust removing unit is in a normal condition.
Figure 5:
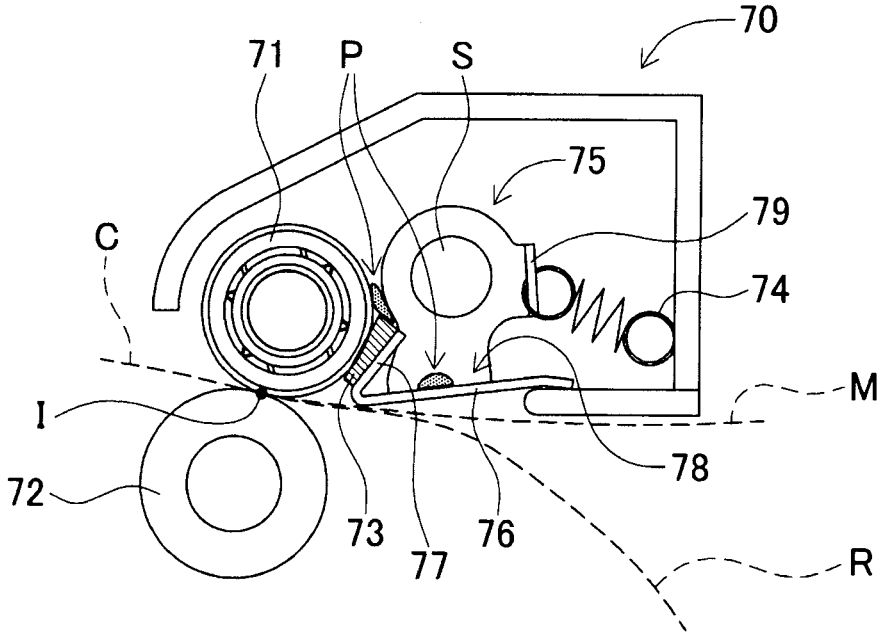
FIG. 5 is another illustrative diagram of the paper dust removing unit showing a state when a sheet abuts against a guiding surface.

The sheet conveying roller 72 conveys the sheet 5 which has been conveyed to the paper dust removing unit 70 toward the sheet conveying part 20 (refer to FIGS. 2, 4 and 5). The sheet conveying roller 72 is provided under the paper dust collecting roller 71 and is opposed to the paper dust collecting roller 71. Under the control of the control part (not shown), the sheet conveying roller 72 cooperates with the paper dust collecting roller 71 to convey the sheet 5 toward the sheet conveying part 20. In addition, a contact point of the paper dust collecting roller 71 and the sheet conveying roller 72 is determined as the intersection point I in the exemplary embodiment.

The paper dust removing member 73 is a sponge-shaped member including urethane foam. The paper dust removing member 73 is provided on the supporting frame 75 (a removing member attaching part 77 which will be described later). The paper dust removing member 73 is provided to press against the surface of the paper dust collecting roller 71. Upon the rotation of the paper dust collecting roller 71, the paper dust removing member 73 scrapes the paper dust P attached onto the surface of the paper dust collecting roller 71. Incidentally, in accordance with the rotation of the paper dust collecting roller 71, the paper dust removing member 73 frictionally contacts the paper dust collecting roller 71 and produces charges on the surface of the paper dust collecting roller 71.

Figure 3:
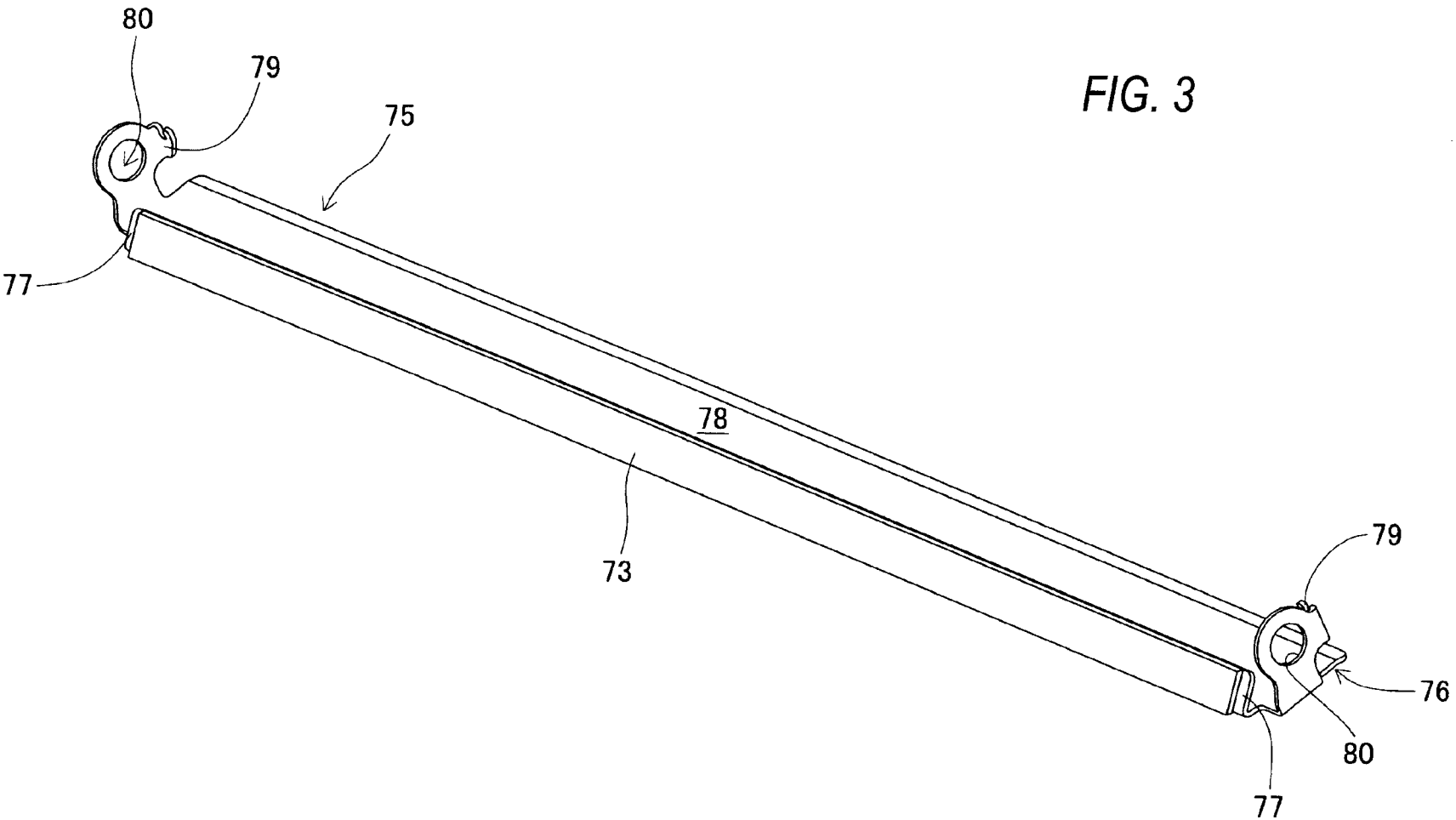
FIG. 3 is a perspective diagram showing a supporting frame.

The supporting frame 75 is made of a conductive material (for example, metal). As shown in FIG. 3, the supporting frame 75 includes a guiding part 76, a removing member attaching part 77, a paper dust receiving part 78, frame supporting parts 79 and shaft holes 80.

The guiding part 76 is formed as a rectangle plate such that long sides thereof correspond to the width direction of the sheet 5. In addition, since the guiding part 76 is located above the first conveying path R and the second conveying path M, the guiding part 76 contacts the sheet 5 conveyed along the first conveying path R and the second conveying path M. Therefore, the guiding part 76 functions as a guiding surface for appropriately guiding the sheet 5 toward the sheet conveying part 20.

The paper dust removing member 73 is provided to the removing member attaching part 77. The removing member attaching part 77 is a plate-shaped part, which is inclined at a determined angle relative to the guiding part 76, and which is formed by extending from the downstream end in the sheet conveying direction of the guiding part 76 to the upstream side in the sheet conveying direction and the side of the paper dust collecting roller 71 (refer to FIGS. 2 to 5). As shown in FIG. 2, the removing member attaching part 77 makes the paper dust removing member 73 to abut against the paper dust collecting roller 71 at an upstream lower part in the conveying direction thereof.

The paper dust receiving part 78 is formed inside an acute angle formed by the guiding part 76 and the removing member attaching part 77. The paper dust receiving part 78 receives the paper dust P removed with the paper dust removing member 73. Specifically, the paper dust receiving part 78 includes the upper surface of the guiding part 76 (the back of the surface contacting the sheet 5) and the back of the surface of removing member attaching part 77 on which the paper dust removing member 73 is provided. As described later, the paper dust P removed by the paper dust removing member 73 is deposited on the upper surface of the paper dust removing member 73. After dropping from the upper surface of the paper dust removing member 73, the paper dust P is accommodated in the paper dust receiving part 78 (which will be described later).

As shown in FIG. 3, the frame supporting parts 79 are vertically set on the two short sides of the guiding part 76. The frame supporting parts 79 include the shaft holes 80. A swing shaft S formed inside the housing 2 is inserted through the shaft holes 80. The swing shaft S is formed in parallel with a rotation axis of the paper dust collecting roller 71 along the width direction of the sheet 5. The supporting frame 75 is supported by the shaft S such that the supporting frame 75 is swingable around the swing shaft S with the cooperation of the swing shaft S and the shaft holes 80.

The coil spring 74 is provided such that one end thereof is connected with a hook (not shown) integrally formed in a predetermined position on the internal surface of housing 2, and the other end thereof is connected with a locking part formed on the frame supporting part 79 (refer to FIG. 3). The coil spring 74 applies a pressing force to the supporting frame 75. The supporting frame 75 receives the pressing force in a rotation direction or a predetermined direction around the swing shaft S (clockwise in FIGS. 4 and 5), which is applied by the coil spring 74. In this way, the paper dust removing member 73 is pressed against the paper dust collecting roller 71 and can remove the paper dust P on the surface of the paper dust collecting roller 71.

Next, the operation of the paper dust removing unit 70 at the time of conveying the sheet 5 will be described with reference to the drawings. In addition, as shown in FIG. 4, the paper dust removing unit 70 remains in a normal condition where the downstream part in the conveying direction of the guiding part 76 is located on the first conveying path R and the second conveying path M.

First, a case where the sheet 5 is conveyed from the sheet feed tray 11 along the first conveying path R will be described. As described above, when the sheet 5 is fed from the sheet feed tray 11, the sheet 5 is conveyed along the first conveying path R by the first sheet feeding unit 12 and reaches the paper dust removing unit 70.

As described above, for the supporting frame 75, the downstream part in the conveying direction of the guiding part 76 is located on the first conveying path R. The sheet 5 is conveyed along the first conveying path R, and draws an arc under the supporting frame 75. Therefore, by contacting the guiding part 76, the sheet 5 fed from the sheet feed tray 11 pushes upwards the downstream end of the guiding part 76 (refer to FIG. 5). In this way, the supporting frame 75 rotates in the predetermined direction around the swing shaft S (clockwise direction in FIGS. 4 and 5) and presses the paper dust removing member 73 against the surface of the paper dust collecting roller 71.

Therefore, by rotating the paper dust collecting roller 71 under this condition, the laser printer 1 can remove the paper dust P attached onto the surface of the paper dust collecting roller 71 with the paper dust removing member 73. Furthermore, by frictionally contacting the paper dust collecting roller 71 and the paper dust removing member 73, the laser printer 1 can reliably charge the paper dust collecting roller 71 and can improve the ability to collect the paper dust P of the paper dust collecting roller 71.

By contacting the guiding part 76, the sheet 5 is guided toward the sheet conveying part 20 along the first conveying path R, and the sheet 5 then reaches the position between the paper dust collecting roller 71 and the sheet conveying roller 72. The paper dust collecting roller 71 contacts the image forming surface of the sheet 5 and holds and conveys the sheet 5 in cooperation with the sheet conveying roller 72. At this time, with electric charge attraction, the paper dust collecting roller 71 collects the paper dust P attached onto the image forming surface of the sheet 5 onto the surface of the paper dust collecting roller 71. In this way, the laser printer 1 can remove the paper dust P from the image forming surface of the sheet 5 and can form images on the image forming surface without having the paper dust P on the surface thereof with using the image forming unit 30.

In this way, the paper dust P collected onto the paper dust collecting roller 71 is scraped with the paper dust removing member 73 that is contacting the paper dust collecting roller 71 and then deposited on the paper dust removing member 73 all the time (refer to FIGS. 4 and 5). Since the paper dust P attached onto the paper dust collecting roller 71 is scraped with the paper dust removing member 73, the laser printer 1 can maintain the adsorption capacity of the paper dust collecting roller 71 for a long time.

Then, the sheet 5 is conveyed toward the sheet conveying part 20 along the common conveying path C. After the sheet 5 passed the guiding part 76, the supporting frame 75 enters a condition that the supporting frame 75 does not contact the sheet 5. In this way, the supporting frame 75 rotates around the swing shaft S in a direction reverse to the direction in which the sheet 5 is in contact with the supporting frame 75 (i.e., counterclockwise direction in FIGS. 4 and 5) and enters into a condition as shown in FIG. 4. In addition, even under such condition, since the pressing force of the coil spring 74 acts on the supporting frame 75, the paper dust removing member 73 keeps contacting the surface of the paper dust collecting roller 71. Therefore, even under such condition, the paper dust P can be removed from the surface of the paper dust collecting roller 71 to the upper surface of the paper dust removing member 73.

In addition, as described above, the supporting frame 75 swings around the swing shaft S in accordance with contact/separate the sheet 5 with/from the guiding part 76 of the supporting frame 75. That is to say, with the conveyance of the sheet 5, the laser printer 1 can move upwards/downwards the upper surface of the paper dust removing member 73. In accordance with the swing of the supporting frame 75, the laser printer 1 can drop the paper dust P deposited on the paper dust removing member 73. Further, as shown in FIGS. 4 and 5, since the paper dust removing member 73 is provided on the removing member attaching part 77 which is inclined at a predetermined angle upstream in the conveying direction, the paper dust P drops from the upper surface of the paper dust removing member 73 toward the paper dust receiving part 78. In this way, the laser printer 1 can appropriately handle the paper dust P removed from the sheet 5. Further, since the paper dust receiving part 78 includes the removing member attaching part 77 downstream in the conveying direction, it is possible to prevent the paper dust P from scattering toward the image forming unit 30 even if the dropped paper dust P scatters.

Next, a case where the sheet 5 is conveyed from the second sheet feeding unit 14 along the second conveying path M will be described. As described above, in the case of feeding the sheet 5 from the second sheet feeding unit 14, the sheet 5 is conveyed by the second sheet feeding unit 14 along the second conveying path M in a substantially horizontal direction and reaches the paper dust removing unit 70.

As described above, for the supporting frame 75, the downstream part in the conveying direction of the guiding part 76 is located on the second conveying path M. The sheet 5 is conveyed from the second sheet feeding unit 14 toward the paper dust removing unit 70 in the substantially horizontal direction along the second conveying path M. Therefore, by contacting the guiding part 76, the sheet 5 fed from the second sheet feeding unit 14 pushes upwards the downstream end of the guiding part 76 (refer to FIG. 5). In this way, the supporting frame 75 rotates in the predetermine direction (i.e., clockwise direction in FIGS. 4 and 5) around the swing shaft S, and presses the paper dust removing member 73 against the surface of the paper dust collecting roller 71.

Therefore, by rotating the paper dust collecting roller 71 under this condition, the laser printer 1 can remove the paper dust P attached onto the surface of the paper dust collecting roller 71 with the paper dust removing member 73. Furthermore, by frictionally contacting the paper dust collecting roller 71 and the paper dust removing member 73, the laser printer 1 can reliably charge the paper dust collecting roller 71 and can improve the ability to collect the paper dust P of the paper dust collecting roller 71.

By contacting the guiding part 76, the sheet 5 is guided toward the sheet conveying part 20 along the second conveying path M and reaches the position between the paper dust collecting roller 71 and the sheet conveying roller 72. Like the case where the sheet 5 is fed from the sheet feed tray 11 described above, with electric charge attraction, the paper dust collecting roller 71 collects the paper dust P, which is attached onto the image forming surface of the sheet 5, onto the surface of the paper dust collecting roller 71. In this way, the laser printer 1 can remove the paper dust P from the image forming surface of the sheet 5 and can form images on the image forming surface without having the paper dust P on the surface thereof.

In this way, the paper dust P collected onto the paper dust collecting roller 71 is scraped with the paper dust removing member 73 by contacting the paper dust collecting roller 71 therewith, and the paper dust P is deposited on the paper dust removing member 73 all the time (refer to FIGS. 4 and 5). Since the paper dust P attached onto the paper dust collecting roller 71 is scraped with the paper dust removing member 73, the laser printer 1 can maintain the absorption capacity of the paper dust collecting roller 71 for a long time.

Then, the sheet 5 is conveyed toward the sheet conveying part 20 along the common conveying path C. After the sheet 5 passed the guiding part 76, the supporting frame 75 does not contact the sheet 5. In this way, the supporting frame 75 rotates around the swing shaft S in a direction reverse to the direction in which the sheet 5 is in contacted with the supporting frame 75 (i.e., counterclockwise rotation in FIGS. 4 and 5) and enters into the condition as shown in FIG. 4. In addition, even under such condition, since the pressing force of the coil spring 74 acts on the supporting frame 75, the paper dust removing member 73 keeps contacting the surface of the paper dust collecting roller 71. Therefore, even under such condition, the paper dust P can be removed from the surface of the paper dust collecting roller 71 to the upper surface of the paper dust removing member 73.

As described above, the supporting frame 75 swings around the swing shaft S in accordance with contact/separate the sheet 5 with/from the guiding part 76 of the supporting frame 75. Therefore, like the case of feeding the sheet from the sheet feed tray 11, with the conveyance of the sheet 5, the laser printer 1 can move upwards/downwards the upper surface of the paper dust removing member 73. In accordance with the swing of the supporting frame 75, the laser printer 1 can drop the paper dust P deposited on the paper dust removing member 73 toward the dust paper receiving part 78. In this way, the laser printer 1 can appropriately handle the paper dust P removed from the sheet 5. In addition, since the paper dust receiving part 78 includes the removing member attaching part 77 downstream in the conveying direction, it is possible to prevent the paper dust P from scattering toward the image forming unit 30 even if the dropped paper dust P scatters.

As described above, the laser printer 1 according to the exemplary embodiment includes an image forming unit 30 and a paper dust removing unit 70. And the paper dust removing unit 70 includes a paper dust collecting roller 71, a sheet conveying roller 72, a paper dust removing member 73 and a supporting frame 75. The supporting frame 75 includes a coil spring 74, a guiding part 76 and a paper dust receiving part 78, and is supported by a shaft and able to swing around the swing shaft S. At the time of forming images on the sheet 5, the laser printer 1 conveys the sheet 5 along the conveying paths (the first conveying path R, the second conveying path M and the common conveying path C). When the sheet 5 is moving along the first conveying path R or the second conveying path M, the paper dust P on the sheet 5 is collected and removed from the sheet 5 with the paper dust collecting roller 71. With the paper dust removing coil member 73 that contacts the paper dust collecting roller 71 under the pressing force of the coil spring 74, the paper dust P collected onto the paper dust collecting roller 71 is removed from the surface of the paper dust collecting roller 71. Therefore, the laser printer 1 can reliably remove the paper dust P attached onto the sheet 5 and form images.

In addition, when the sheet 5 is conveyed along the first conveying path R or the second conveying path M, the sheet 5 contacts the guiding part 76 of the supporting frame 75 and is guided along the conveying paths with the guiding part 76. Therefore, the laser printer 1 can make the supporting frame 75 provided with the paper dust removing member 73 function not only as a part of the paper dust removing unit 70 and but also as a mechanism used for the smooth conveyance of the sheet 5.

Furthermore, since the supporting frame 75 is supported by the shaft S and is able to swing around the swing shaft S though the shaft hole 80, when the sheet 5 contacts the guiding part 76, the supporting frame 75 is moved toward a direction in which the paper dust removing member 73 is pressed against the paper dust collecting roller 71. Then, with the pressing force of the coil spring 74, the supporting frame 75 returns to a predetermined position where the paper dust removing member 73 contacts the paper dust collecting roller 71. According to the contact of this sheet 5 and the guiding part 76 and according to the pressing force of the coil spring 74, the supporting frame 75 swings so as to drop the paper dust P removed by the paper dust removing member 73 from the paper dust removing member 73 toward the paper dust receiving part 78 (refer to FIGS. 4 and 5). In this way, the laser printer 1 can appropriately handle the paper dust P removed from the sheet 5.

As described above, the supporting frame 75 can function not only as a part of the paper dust removing unit 70 for the sheet 5 but also as a member for smoothly conveying the sheet. Therefore, for the laser printer 1, compared with the paper dust removing unit 70 and the member used for smoothly conveying the sheet (for example, the guide wall as a part of the conveyance path) that are separately provided, the paper dust removing unit 70 can be arranged in a small space. As a result, for the laser printer 1, the arrangement area of the paper dust removing unit 70 can be reduced in this way, which makes contribution to reduce the size of the laser printer 1. According thereto, the laser printer 1 can meet the user's demand for reducing the size of the apparatus.

In addition, the supporting frame 75 includes a removing member attaching part 77, and the paper dust removing member 73 is provided on a surface of the removing member attaching part 77 (the surface opposed to the paper dust collecting roller 71). The removing member attaching part 77 extends from an end portion of the guiding part 76 located downstream in the conveying direction of the sheet 5 to the upstream side in the conveying direction of the sheet 5 and the side of the paper dust collecting roller 71. Then, the removing member attaching part 77 is inclined at a predetermined angle relative to the guiding part 76. As described above, since the supporting frame 75 is supported by the shaft and able to swing around the swing shaft S, when the supporting frame 75 swings toward the paper dust collecting roller 71 due to the pressing force of the coil spring 74, it is possible to make the paper dust removing member 73 contact a predetermined position of the paper dust collecting roller 71 at high accuracy. As a result, the laser printer 1 can reliably remove the paper dust P collected onto the paper dust collecting roller 71 with the paper dust removing member 73. Furthermore, since the paper dust removing member 73 is provided on the removing member attaching part 77, the paper dust P removed with the paper dust removing member 73 will not scatter in the downstream conveying direction, but drops toward the paper dust receiving part 78 (refer to FIGS. 4 and 5). In this way, the laser printer 1 can appropriately handle the paper dust P removed from the sheet 5.

In addition, the laser printer 1 includes a first conveying path R relating to the sheet feed tray 11 and a second conveying path M relating to the manual feed tray 13. The supporting frame 75 is provided upstream in the conveying direction of sheet 5 from the intersection point I of the first conveying path R and the second conveying path M (refer to FIGS. 2, 4 and 5). Therefore, in the case of feeding the sheet 5 from the sheet feed tray 11 along the first conveying path R, or in the case of feeding the sheet 5 from the manual feed tray 13 along the second conveying path M, the laser printer 1 can smoothly convey the sheet 5 with the supporting frame 75, and can remove the paper dust P attached onto the sheet 5.

Furthermore, the supporting frame 75 is made of a material that is conductive (for example, metal). Therefore, when the sheet 5 contacts the guiding part 76, the supporting frame 75 can remove the static electrical charge carried by the sheet 5. As a result, the laser printer 1 can prevent the failure (for example, the malfunction of the image forming unit 30 or the control error of the control part) due to the static electrical charge carried by the sheet 5.

The feeder unit 10, the sheet conveying part 20, the fixing part 50, the discharging roller 61, the sheet discharging roller 62, and the paper dust removing unit 70 in the exemplary embodiment are equivalent to the sheet feeding device of the present invention. However, the sheet feeding device of the present invention is not limited to the configuration of the exemplary embodiment. Further, the sheet feeding device has the same effect as the laser printer 1 in the exemplary embodiment.

The present invention is not limited to any of the above-described exemplary embodiments, and it is possible to make various improvement and modifications without departing from the scope of the present invention. For example, a color laser printer using LED unit 35 serves as the exposure device, but the present invention is not limited to this embodiment. For example, a color laser printer including a polygon mirror is also preferred. Furthermore, in the above-described exemplary embodiment, a laser printer that can perform color printing is used, but the laser printer is not limited thereto. For example, a black-and-white laser printer can be used.

Furthermore, in the above-described exemplary embodiment, the laser printer 1 has been described as the image forming apparatus. However, the image forming apparatus is not limited thereto. For example, the mode of forming images is not necessarily related to laser, and it is also preferred to use various printing modes in which the configuration can be used (for example, ink-jet mode).

According to another illustrative aspect of the invention, in the image forming apparatus, wherein the supporting member further comprises an inclined surface, which is inclined at a predetermined angle relative to the guiding surface, and which extends from an end portion of the guiding surface at a downstream side in the conveying direction of the sheet toward an upstream side in the conveying direction of the sheet so as to face the paper dust collecting roller, and wherein the paper dust removing member is provided on the inclined surface.

As described above, since the supporting member is supported by a shaft and able to swing around the shaft, when the supporting member swings toward the paper dust collecting roller due to the pressure force of the press mean, it is possible to make the paper dust removing member contact a predetermined position of the paper dust collecting roller at high accuracy. As a result, the image forming apparatus can reliably remove the paper dust collected onto the paper dust collecting roller with the paper dust removing member. Furthermore, since the paper dust removing member is provided on the inclined surface, the paper dust removed with the paper dust removing member will not scatter in the downstream conveying direction, but drops toward the paper dust receiving part. In this way, the image forming apparatus can appropriately handle the paper dust removed from the sheet.

According to still another illustrative aspect of the invention, the image forming apparatus further comprises: a first sheet feed tray that accommodates the sheet; a second sheet feed tray that is provided at a position different from the first sheet feed tray; a first conveying path along which the sheet is conveyed from the first sheet feeding tray toward the image forming part; and a second conveying path along which the sheet is conveyed from the second sheet feed tray toward the image forming part, wherein the supporting member is provided upstream in the conveying direction of the sheet from an intersection point of the first conveying path and the second conveying path.

According thereto, when the sheet is conveyed along the first conveyance path or along the second conveyance path, the image forming apparatus can smoothly convey the sheet with the supporting member and can remove the paper dust attached onto the sheet.

According to still another illustrative aspect of the invention, in the image forming apparatus, wherein the intersection point corresponds to a contact point of the paper dust collecting roller and the conveying roller.

According to still another illustrative aspect of the invention, the image forming apparatus further comprises: a first sheet feed tray; a first sheet feeding unit that feeds the sheet from the first sheet feed tray toward the image forming part via a first conveying path; a second sheet feed tray that is provided at a position different from the first sheet feed tray; and a second sheet feeding unit that feeds the sheet from the second sheet feed tray toward the image forming part via a second conveying path, wherein the supporting member is provided upstream in the conveying direction of the sheet from an intersection point of the first conveying path and the second conveying path.

According to still another illustrative aspect of the invention, in the image forming apparatus, wherein the first sheet feed tray is provided below the image forming part, and wherein the second sheet feed tray that is provided at a front side of the image forming part.

According to still another illustrative aspect of the invention, in the image forming apparatus, wherein the supporting member is provided downstream in the conveying direction of the sheet from the first sheet feeding unit and the second sheet feeding unit.

According to still another illustrative aspect of the invention, in the image forming apparatus, wherein when the sheet conveyed along the conveying paths contacts the guiding surface, the supporting member swings around the swing shaft by a force generated from the contact between the sheet and the guiding surface and the pressing force of the pressing member, and the paper dust removed by the paper dust removing member drops from the paper dust removing member toward the paper dust receiving part in accordance with the swing of the supporting member.

According thereto, the image forming apparatus can remove the paper dust while guiding the sheet along the conveying paths, and can appropriately handle the paper dust removed from the sheet.

According to still another illustrative aspect of the invention, in the image forming apparatus, wherein the supporting member includes a conductive material.

According thereto, when the sheet conveyed along the conveying paths contacts the guiding surface, the supporting member can remove the static electrical charge carried by the sheet. As a result, the image forming apparatus can prevent the failure (for example, the malfunction of the image forming unit or the control error) due to the static electrical charge carried by the sheet.

According to still another illustrative aspect of the invention, in the sheet feeding device, wherein the supporting member further comprises an inclined surface, which is included at a predetermined angle relative to the guiding surface, and which extends from an end portion of the guiding surface at a downstream side in the conveying direction of the sheet toward an upstream side in the conveying direction of the sheet so as to face the paper dust collecting roller, and wherein the paper dust removing member is provided on the inclined surface.

As described above, since the paper dust removing member contacts a predetermined position of the paper dust collecting roller at high accuracy, and the sheet feeding device can reliably remove the paper dust collected onto the paper dust collecting roller with the paper dust removing member. Furthermore, since the paper dust removing member is provided on an inclined surface, the paper feeding device can appropriately handle the paper dust removed from the sheet.

According to still another illustrative aspect of the invention, in the sheet feeding device, wherein when the sheet conveyed along the conveying path contacts the guiding surface, the supporting member swings around the swing shaft by a force generated from the contact between the sheet and the guiding surface and the pressing force of the pressing member, and the paper dust removed with the paper dust removing member drops from the paper dust removing member toward the paper dust receiving part in accordance with the swing of the supporting member.

According thereto, the sheet feeding device can remove the paper dust while guiding the sheet along the conveying path, and thus can appropriately handle the paper dust removed from the sheet.

According to still another illustrative aspect of the invention, in the sheet feeding device, wherein the supporting member includes a conductive material.

According thereto, since the sheet feeding device removes the static electrical charge carried by the sheet conveyed along the conveying path, and the sheet feeding device can prevent the failure resulting from the static electrical charge of the installed device.

What is claimed is:

1. An image forming apparatus comprising:

an image forming part configured to form an image on a sheet;

a paper dust collecting roller configured to collect paper dust from the sheet conveyed along a conveying path toward the image forming part;

a conveying roller, which is provided in a position opposed to the paper dust collecting roller, and which is configured to convey the sheet toward the image forming part;

a paper dust removing member, which is provided upstream in a conveying direction of the sheet from the paper dust collecting roller and the conveying roller in the conveying path, and which is configured to contact the paper dust collecting roller for removing the paper dust collected onto the paper dust collecting roller;

a supporting member extending in a direction parallel with a rotation axis of the paper dust collecting roller;

a swing shaft, which is provided in parallel with the rotation axis of the paper dust collecting roller, and which supports the supporting member for allowing the supporting member to swing around the swing shaft; and a pressing member configured to apply a pressing force to the supporting member so as to rotate the supporting member around the swing shaft in a direction in which the paper dust removing member contacts the paper dust collecting roller, wherein the supporting member comprises:

a guiding surface configured to contact the sheet conveyed along the conveying path for guiding the sheet toward the image forming part along the conveying path;

a removing member attaching part, on which the paper dust removing member is provided, wherein the removing member attaching part is inclined at an acute angle relative to the guiding surface and extends from an end portion of the guiding surface at a downstream side in the conveying direction of the sheet toward an upstream side in the conveying direction of the sheet so as to face the paper dust collecting roller, the end portion of the guiding surface at the downstream side in the conveying direction being configured to be located on the conveying path; and a paper dust receiving part, which is provided inside the acute angle formed by the guiding surface and the removing member attaching part and upstream in the conveying direction of the sheet from the paper dust removing member, and which is configured to receive the paper dust removed by the paper dust removing member.

2. The image forming apparatus according to claim 1, further comprising:

a first sheet feed tray configured to accommodate the sheet;

a second sheet feed tray that is provided at a position different from the first sheet feed tray;

a first conveying path along which the sheet is conveyed from the first sheet feeding tray toward the image forming part and a second conveying path along which the sheet is conveyed from the second sheet feed tray toward the image forming part, wherein the supporting member is provided upstream in the conveying direction of the sheet from an intersection point of the first conveying path and the second conveying path.

3. The image forming apparatus according to claim 2, wherein the intersection point corresponds to a contact point of the paper dust collecting roller and the conveying roller.

4. The image forming apparatus according to claim 1, further comprising:

a first sheet feed tray;

a first sheet feeding unit configured to feed the sheet from the first sheet feed tray toward the image forming part via a first conveying path;

a second sheet feed tray that is provided at a position different from the first sheet feed tray; and a second sheet feeding unit configured to feed the sheet from the second sheet feed tray toward the image forming part via a second conveying path, wherein the supporting member is provided upstream in the conveying direction of the sheet from an intersection point of the first conveying path and the second conveying path.

5. The image forming apparatus according to claim 4, wherein the first sheet feed tray is provided below the image forming part, and wherein the second sheet feed tray that is provided at a front side of the image forming part.

6. The image forming apparatus according to claim 4, wherein the intersection point corresponds to a contact point of the paper dust collecting roller and the conveying roller.

7. The image forming apparatus according to claim 4, wherein the supporting member is provided downstream in the conveying direction of the sheet from the first sheet feeding unit and the second sheet feeding unit.

8. The image forming apparatus according to claim 1, wherein when the sheet conveyed along the conveying paths contacts the guiding surface, the supporting member swings around the swing shaft by a force generated from the contact between the sheet and the guiding surface and the pressing force of the pressing member, and the paper dust removed by the paper dust removing member drops from the paper dust removing member toward the paper dust receiving part in accordance with the swing of the supporting member.

9. The image forming apparatus according to claim 1, wherein the supporting member includes a conductive material.

10. The image forming apparatus according to claim 1, wherein the supporting member is configured to swing around the swing shaft upon receiving a force by the end portion of the guiding surface to cause the paper dust removing member to be pressed against the paper dust collecting roller.

11. A sheet feeding device comprising:

a paper dust collecting roller configured to collect paper dust from a sheet conveyed along a conveying path;

a conveying roller, which is provided in a position opposed to the paper dust collecting roller, and which is configured to convey the sheet along the conveying path;

a paper dust removing member, which is provided upstream in a conveying direction of the sheet from the paper dust collecting roller and the conveying roller in the conveying path, and which is configured to contact the paper dust collecting roller for removing the paper dust collected onto the paper dust collecting roller;

a supporting member extending in a direction parallel with a rotation axis of the paper dust collecting roller;

a swing shaft, which is provided in parallel with the rotation axis of the paper dust collecting roller, and which is configured to support the supporting member for allowing the supporting member to swing around the swing shaft;

a pressing member configured to apply a pressing force to the supporting member so as to rotate the supporting member around the swing shaft in the direction in which the paper dust removing member contacts the paper dust collecting roller, wherein the supporting member comprises:

a guiding surface configured to contact the sheet conveyed along the conveying path for guiding the sheet along the conveying path;

a removing member attaching part, on which the paper dust removing member is provided, wherein the removing member attaching part is inclined at an acute angle relative to the guiding surface and extends from an end portion of the guiding surface at a downstream side in the conveying direction of the sheet toward an upstream side in the conveying direction of the sheet so as to face the paper dust collecting roller, the end portion of the guiding surface at the downstream side in the conveying direction of the sheet being configured to be located on the conveying path; and a paper dust receiving part, which is provided inside the acute angle formed by the guiding surface and the removing member attaching part and upstream in the conveying direction of the sheet from the paper dust removing member, and which is configured to receive the paper dust removed by the paper dust removing member.

12. The sheet feeding device according to claim 11, wherein when the sheet conveyed along the conveying path contacts the guiding surface, the supporting member swings around the swing shaft by a force generated from the contact between the sheet and the guiding surface and the pressing force of the pressing member, and the paper dust removed with the paper dust removing member drops from the paper dust removing member toward the paper dust receiving part in accordance with the swing of the supporting member.

13. The sheet feeding device according to claim 11, wherein the supporting member includes a conductive material.

14. The sheet feeding device according to claim 11, wherein the supporting member is configured to swing around the swing shaft upon receiving a force by the end portion of the guiding surface to cause the paper dust removing member to be pressed against the paper dust collecting roller.

* * * * *